United States Patent [19]

Traut

[11] 4,101,248

[45] Jul. 18, 1978

[54] ROTARY GAS EXPANSION MOTOR

[76] Inventor: Earl William Traut, 8040 Palm Lake Dr., Orlando, Fla. 32811

[21] Appl. No.: 788,516

[22] Filed: Apr. 18, 1977

[51] Int. Cl.[2] ..... F04B 23/10; F01C 1/02; F01C 21/14

[52] U.S. Cl. ..... 417/204; 418/61 B

[58] Field of Search ..... 418/54, 61 B; 417/204, 417/199 R, 206

[56] References Cited

U.S. PATENT DOCUMENTS

| | | | |
|---|---|---|---|
| 302,179 | 7/1884 | Walker | 418/54 |
| 1,277,018 | 8/1918 | Wolfington | 418/61 B |
| 2,162,771 | 6/1939 | Winans | 418/61 B |
| 3,285,189 | 11/1966 | Doyer | 418/61 B |
| 3,301,228 | 1/1967 | Winans | 418/61 B |
| 3,307,525 | 3/1967 | McClure | 418/61 B |
| 3,922,120 | 11/1975 | McCullough et al. | 418/61 B |
| 3,996,901 | 12/1976 | Gale et al. | 418/61 B |

FOREIGN PATENT DOCUMENTS

| | | | |
|---|---|---|---|
| 28,321 | 9/1964 | Japan | 418/61 B |

*Primary Examiner*—John J. Vrabilk

[57] ABSTRACT

A compact, rotary gas-operated motor having only two moving components, including valving. Pressurized gas causes an elongate rotor to rotate end-over-end within a generally triangular chamber and causes a crank to slide in a slot in the elongate rotor. A disk rotating with the shaft includes ports to admit pressurized gas and exhaust spent gas. The inlet port is shaped and positioned to provide early cut-off of inlet gas and provide up to 2:1 expansion ratio of the pressurized gas. Still earlier cut-off of inlet gas, at a location between the rotating disk and its housing, provides expansion ratios as high as 9:1. A movable guillotine may be used to provide continuously variable expansion ratios of from about 3:1 to 9:1.

6 Claims, 10 Drawing Figures

10
11
12
13
13a
13b
13c
14
15
15a
15b
15c
15e
15f
16
17
18
19
20
20a
2
4
31
50
55c

ROTARY GAS EXPANSION MOTOR

RELATIONSHIP TO PRIOR INVENTION

This invention bears a definite relationship to my U.S. Pat. No. 4,008,982 entitled "Rotary Fluid Energy Converter", which issued Feb. 22, 1977.

BACKGROUND OF THIS INVENTION

1. Field of the Invention

This invention relates to that class of device involving a rotor which rotates within a chamber in continuous contact with its walls, dividing the chamber into two variable volume compartments. Both the rotor and a crank which slides back and forth within a slot in the rotor are acted upon by gases to produce rotation of a shaft; gases being admitted and exhausted through ports in a disk which is affixed to a shaft and which is adjacent the chamber and rotor. This invention involves novel means of sizing the inlet port and using additional means for early cut-off of gas to the motor to provide gas expansion ratios of up to 9:1, thereby efficiently utilizing the energy of hot, high pressure gases.

2. Description of prior art

Most positive displacement gas-expansion motors in use today, if of the rotary type, require complex sealing means, valving means, and precision gearing; the expansion ratio being limited by the geometry of the rotor and by the valving.

SUMMARY OF THIS INVENTION

This invention relates to a rotary, positive displacement, space-effective, gas operated motor in which novel valving means permits gas flow to be cut off during the power strokes of its rotor and crank, this requiring hot, compressed gases flowing through it to more efficiently expand their energy as they cause mechanical rotation.

For the purpose of this invention, expansion ratio is defined as being the maximum volume of a chamber compartment or slot cell compared to the reduction in its volume when inlet gases cease to be admitted thereto.

As an elongate rotor rotates end-over-end inside a generally triangular chamber, a crank oscillates within a slot in the rotor. A disk covering the greater portion of one end of the chamber is coaxially affixed to an output shaft and has a crank affixed to it, the disk thus being adjacent the chamber and the rotor. Two ports in this disk rotate with it and are so shaped and located in it that one of them communicates with one side of the rotor and one side of the crank to act as an inlet, while the second port communicates with the other side of the rotor and the other side of the crank to act as an outlet. In this invention the inlet port is smaller than the outlet port and is shaped to open to a chamber compartment or a rotor slot cell for less than a full power stroke, the gas trapped in these spaces thus being required to expand during the remainder of the power stroke, resulting in an expansion ratio between 1:1 and 2:1.

Inlet gas may enter the disk either radially inwardly or axially through a housing which supports both the drive shaft and the disk. By using one or more slots in this housing which communicate with the inlet port only during certain portions of the disk rotation, the periods during which gas can enter a chamber compartment or slot cell may be further restricted, thus permitting gas expansion ratios of up to about 9:1. The length of this slot in the housing determines the expansion ratio; a long slot resulting in a low expansion ratio, a short slot providing a high expansion ratio.

One variation of the invention provides for a guillotine to slide back and forth in the slot in the housing adjacent the disk and thus provide a continuously variable expansion ratio. A further variation includes a diaphragm attached to the guillotine, so that the expansion ratio may be altered by changes in gas inlet pressure or other fluid pressure source.

Accordingly, it is an object of the present invention to provide a positive displacement rotary gas operated motor into which gases are admitted only for the initial portion of each power stroke; these gases expanding during the remainder of the power stroke.

Another object of the invention is to provide a gas operated motor which accommodates a greater amount of fluid flow for its size than other rotary devices including the Wankel engine, thus permitting it to be comparatively small and light in weight.

It is a further object of the invention to provide a rotary gas expansion motor which has only two moving components including valving and which requires no gears.

It is yet another object of the invention to provide a rotary gas expansion motor having predetermined expansion ratios between 1:1 and 9:1.

A still further object of the invention is to provide a rotary gas expansion motor whose expansion ratio may be varied while the motor is in operation.

Still another object of the invention is to automatically change the expansion ratio in a gas operated rotary motor by means of pressurized fluid acting on a diaphragm.

These and other objects, features and advantages will be more apparent from a study of the appended drawings in which.

DETAILED DESCRIPTION

Figures 1, 1A, 2, 3, 5:
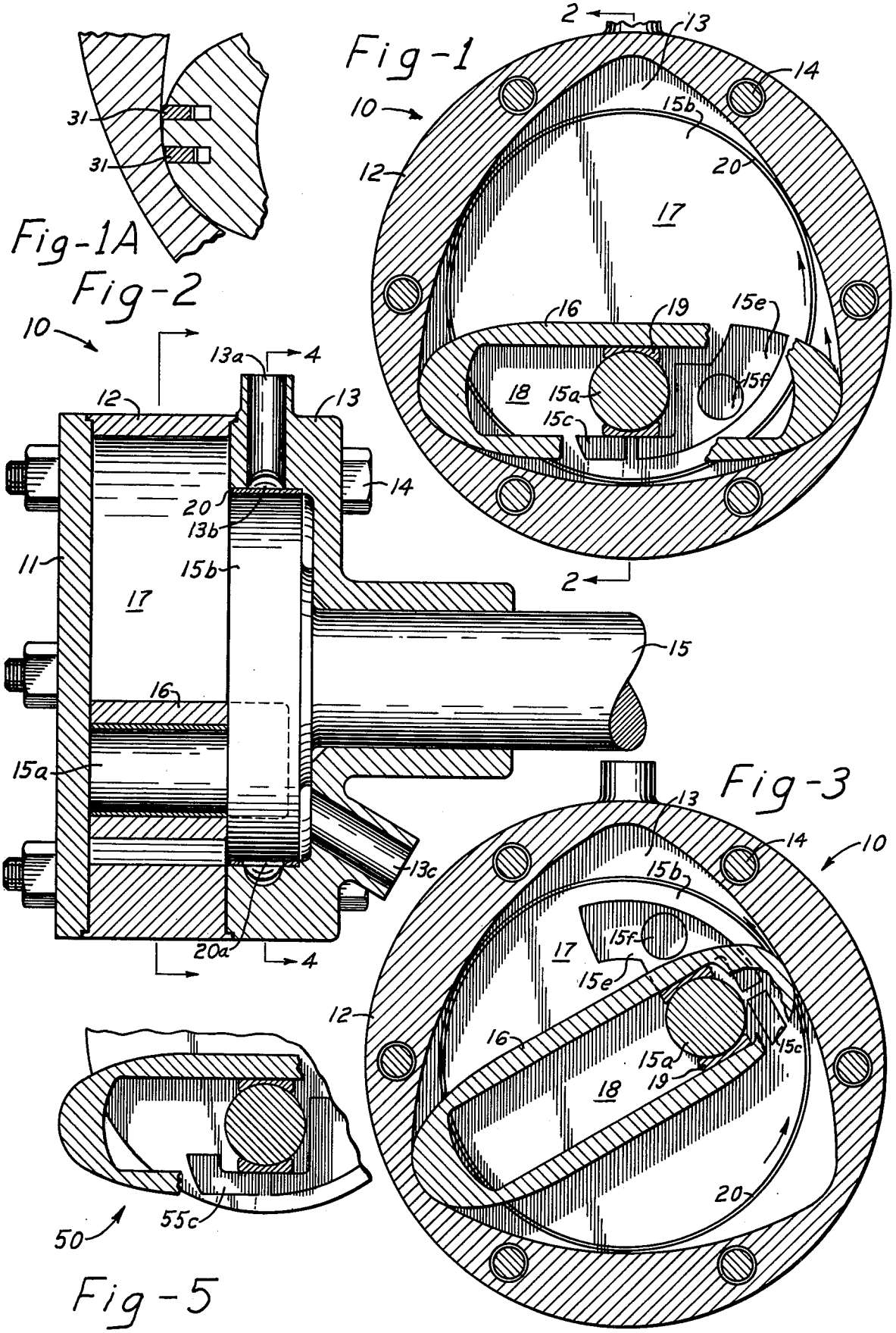
FIG. 1 is a vertical sectional view of a rotary gas expansion motor through its chamber, rotor and crank, with portions of the rotor being broken away to reveal details of the ports in the disk.
FIG. 1A is a sectional view of a portion of a chamber and rotor similar to that of FIG. 1 but including sealing strips at the end of the rotor.
FIG. 2 is a cross sectional view taken along lines 2—2 of FIG. 1 and looking in the direction of the arrows to show the gas inlet and outlet means.
FIG. 3 is a cross sectional view similar to that of FIG. 1 showing the position of the components after 30° of rotor rotation and 120° of crank rotation.
FIG. 5 is a cross sectional view of a portion of the rotor, disk and crank of a gas expansion motor whose inlet port is somewhat enlarged to provide an expansion ratio between 1:1 and 2:1.

Turning now to FIGS. 1, 2, 3 and 4, there will be seen rotary gas expansion motor 10, in which gas flowing into a generally triangular chamber causes an elongate rotor to rotate end-over-end therein.

The stationary components of motor 10 are: end housing 11; chamber housing 12, which encloses triangular chamber 17; shaft housing 13, which includes inlet 13*a*, annular opening 13*b* and outlet 13*c*; ring 20, which is press fitted into housing 13 and has three equally spaced arcshaped holes 20*a*; and six bolts 14 with nuts to fasten the three housings together.

The dynamic components include shaft 15 with its affixed crank 15*a* and disk 15*b*, elongate rotor 16 with its internal elongate slot 18, and shoes 19 which support crank 15*a* in slot 18. Note that disk 15*b* includes inlet port 15*c* which, as can best be seen in FIG. 4, connects through hole 15*d* to ring 20 or one of its three arc-shaped openings 20*a*, and thence to annular opening 13*b* and inlet 13*a*. Disk 15*b* also includes outlet port 15*e* and hole 15*f* which communicate through the space between disk 15*b* and housing 13 with outlet 13*c*.

Looking primarily at FIG. 1, it can be seen that inlet port 15*c* is blocked by the lower side of rotor 16 and that outlet port 15*e* is in communication only with the slot 18 cell which is on the right side of crank 15*a*. When motor 10 is in operation, rotation being in the direction of the arrows, gas pressure from the previous cycle in the slot 18 cell on the left side of crank 15*a* will cause it to move to the right and cause the right end of rotor 16 to begin to move upwards. This movement exposes inlet port 15*c* to the chamber 17 compartment under rotor 16 and outlet port 15*e* to the chamber 17 compartment above rotor 16. The right end, rather than the left end, of rotor 16 will rise because gas pressure in the left slot 18 cell will tend to hold the left end of rotor 16 in the lower left corner of chamber 17. However, if desired, mechanisms such as those disclosed in my U.S. Pat. No. 3,008,982 may be used to mechanically prevent reverse rotation of rotor 16.

During the first 30° of counterclockwise rotation of rotor 16 and 120° of counterclockwise rotation of crank 15*a* and disk 15*b*, the dynamic components will move from their positions of FIG. 1 to the positions shown in FIG. 3, and gas trapped in the left slot 18 cell will expand at an approximately 2:1 ratio. Gas in the right slot 18 cell will exhaust through outlet port 15*e*, gas under pressure will enter the chamber 17 compartment below rotor 17 from inlet port 15*c* during the initial part of the movement and will be cut off therefrom for the remainder of the movement by ring 20 as will be discussed later, and gas in the chamber compartment above rotor 16 will exhaust through outlet port 15*e*.

When the dynamic components are positioned as shown in FIG. 3, inlet port 15*c* has just ceased communicating with the chamber 17 compartment below rotor 16 and is just beginning to communicate with the right slot 18 cell. Outlet port 15*e* has just stopped communicating with the right slot 18 cell and and continues to communicate with the chamber 17 compartment above rotor 16.

During a further 30° of counterclockwise rotation of rotor 16: gas in the chamber 17 compartment below rotor 16 will expand at about a 2:1 ratio; gas in the chamber compartment above rotor 16 will exhaust through outlet port 15*e*; gas under pressure will enter the right slot 18 cell during the initial part of the rotation and be cut off therefrom during the remainder of the rotation by ring 20, as will be discussed later; and gas in the left slot 18 cell will exhaust through port 15*e*.

After this second 30° of rotation of rotor 16, rotor 16 will be adjacent the left wall of chamber 17 and the dynamic components will have the same position relative to the left wall as they did initially to the bottom wall of chamber 17 in FIG. 1.

Thus, after a total of 60° rotation of rotor 16 and 240° rotation of crank 15*a* there has been a complete power stroke, or movement, by rotor 16, and the last and first halves respectively of power strokes by crank 15*a* in slot 18. So, 720° , or two complete revolutions of shaft 15, will result from three power movements by rotor 16 and three power movements by crank 15*a*.

Figure 4:
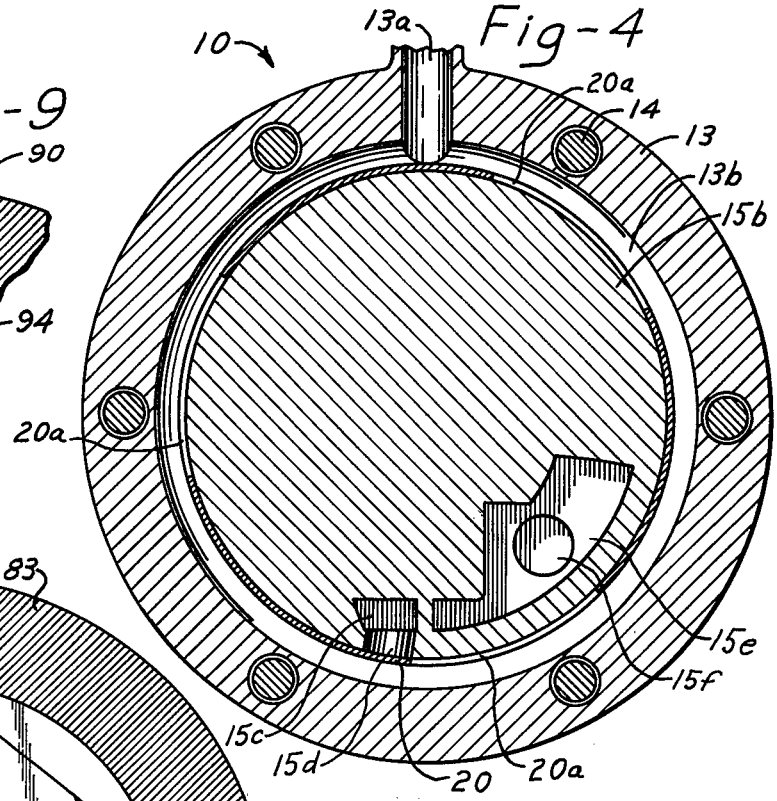
FIG. 4 is a cross sectional view taken along lines 4—4 of FIG. 2 and looking in the direction of the arrows to reveal details of how inlet fluid is admitted to the motor only during portions of the power movements.

Looking primarily at FIGS. 1 and 4, it can be seen that there are three arc-shaped openings 20*a* in ring 20; openings 20*a* being peripherally and equally spaced around disk 15*b*, communicating with each other through annulus 13*b* and with inlet 13*a*. The dynamic components have the same position in FIGS. 1 and 4, so it can be seen that hole 15*d* begins to communicate with the lower opening 20*a* at the same time that port 15*c* begins to communicate with the chamber 17 compartment under rotor 16. But, after about 60° of counterclockwise rotation of disk 15*b*, duct 15*d* passes lower opening 20*a*, and no additional gas can enter the chamber 17 compartment below rotor 16 during the next 60° rotation of disk 15*b*. As was stated earlier, no gas enters under rotor 16 during the second 120° rotation of disk 15*b*. Thus, the pressurized gas that entered under rotor 16 during the first 60° of rotation of disk 15*b* expands during the remainder of the first 240° of rotation of disk 15*b*, resulting in an overall expansion ratio of about 4:1. The action of hole 15*d* with respect to openings 20*a* will similarly cut off inlet gas entering rotor slot 18 cells, again resulting in about a 4:1 expansion ratio therein.

Obviously, decreasing the length of openings 20*a* will increase the expansion ratio; and increasing the length of openings 20*a* will decrease the expansion ratio. A complete annular opening 13*b* in communication with port 15*c* will result in an expansion ratio of about 2:1. It can be seen in FIG. 5 that if inlet port 55*c* is increased in size, it will communicate with slot cells and chamber compartments for a greater portion of the rotation, resulting in an expansion ratio of less than 2:1, assuming that inlet 13*a* is in continuous communication with port 15*c*. When the dimensions of inlet port 55*c* are increased to the size of outlet port 15*e* of FIGS. 1–4, the expansion ratio will be 1:1, that is, gas pressure will be acting continuously.

The foregoing discussion has assumed that motor 10 is in operation. It should be noted in FIG. 4 that if motor 10 is stopped, inlet duct 15*d* is blocked from openings 20*a*; gas entering inlet 13*a* thus being unable to act upon rotor 16 or crank 15*a* to initiate rotation. One way to overcome this is to use two or more separate chambers and rotors which utilize interconnected cranks and operate out of phase with each other, so that there is always pressurized gas access to at least one of the dynamic components, as in FIGS. 5–7 of my U.S. Pat. No. 4,008,982.

It should be noted that the action of crank 15*a* in rotor slot 18 is such that the rotor gradually accelerates from a position at rest adjacent a chamber wall to a maximum velocity when halfway through its travel, as in FIG. 3, and then gradually decelerates as it approaches the next chamber wall. Also, there is always a positive relationship between the position of crank 15*a* and rotor 16, this being obtained without the use of gears.

Although sealing means are not shown in FIGS. 1–4, seals would be desireable in most applications and could be similar to those illustrated in my U.S. Pat. No. 4,008,982. Or, inasmuch as rotor 16 is always perpendicular to the chamber wall it contacts, two or more linear sealing strips may be used at each end of the rotor. FIG. 1A shows two sealing strips 31 at the end of the rotor, the remainder of the device being the same as in FIG. 1.

Figure 6:
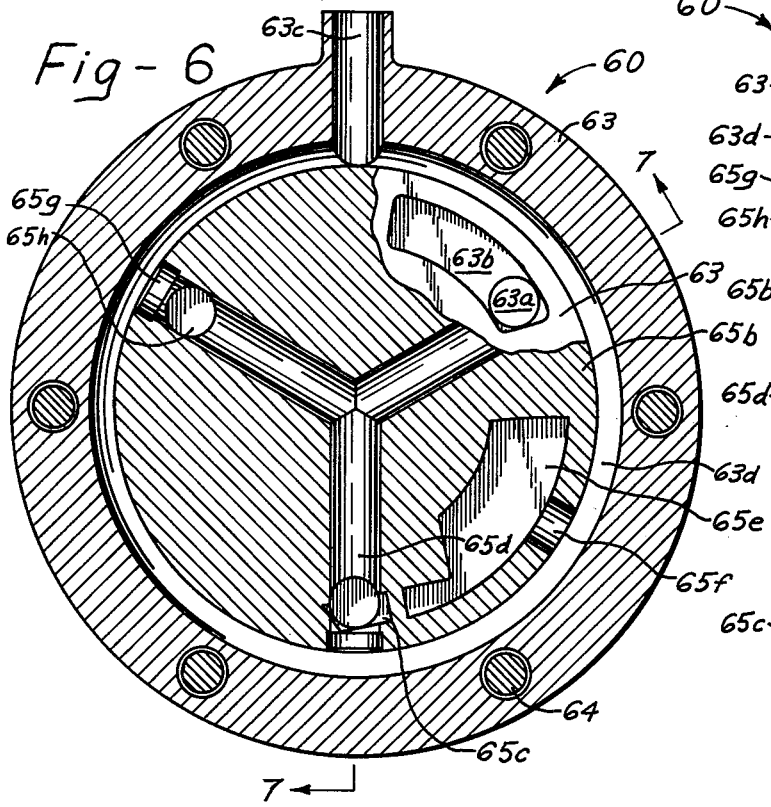
FIG. 6 is a vertical cross sectional view through the disk and housing of a rotary gas expansion motor similar to that of FIG. 1, except that different means of fluid inlet and outlet are used, in accordance with another embodiment of the invention.
Figure 7:
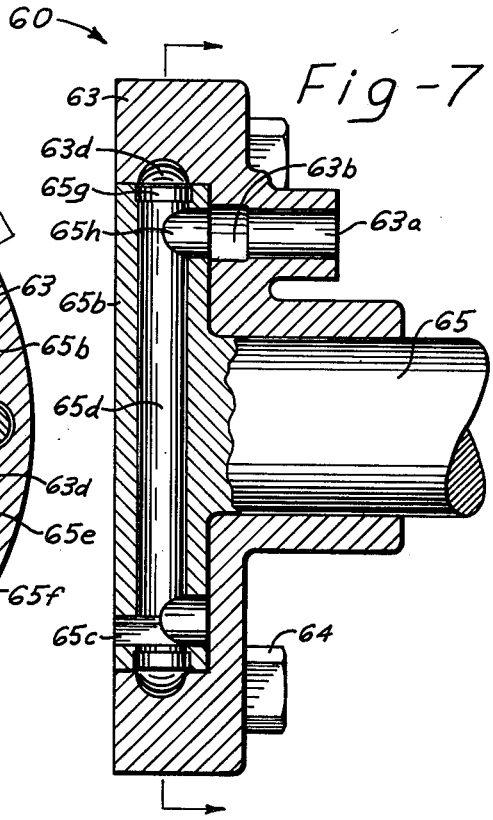
FIG. 7 is a cross sectional view taken along lines 7–7 of FIG. 6 and looking in the direction of the arrows to show the gas communication means between the inlet to the motor and the inlet port.

FIGS. 6 and 7 depict rotary gas expansion motor 60 wich is similar to motor 10 in that it has an expansion ratio of about 4:1 and can be designed for larger or smaller expansion ratios. However, in FIGS. 6 and 7, inlet gas enters the disk axially and spent gas departs radially, instead of the opposite in motor 10. Only the shaft, disk and housing are shown in FIGS. 6 and 7, the other components being essentially the same as in motor 10.

In motor 60, shaft housing 63 includes inlet 63*a*, a single arc-shaped opening 63*b*, outlet 63*c* and annular duct 63*d*. Bolts 64 hold the stationary components together. Shaft 65 and disk 65*b* are closely and rotatably fitted inside housing 63. Disk 65*b* includes inlet port 65*c* and three equally spaced, interconnected inlet ducts 65*d*. Inlet ducts 65*d* are radially bored into disk 65*b* and have sealing plugs 65*g* inserted into their outward ends. As can best be seen in FIG. 7, three equally spaced holes 65*h* are drilled through the right side of disk 65*b* to connect with inlet ducts 65*d*. Each of these holes 65*h* will communicate with arc-shaped opening 63*b* for about 60° of revolution of shaft 65, or about ¼ of each 240° power movement, as in motor 10, thus resulting in an approximately 4:1 expansion ratio. Spent gases are collected in outlet port 65*e* and pass through hole 65*f*, annular duct 63*d* and outlet 63*c*.

In a variation of device 60, instead of using three inlet ducts 65*d* with three connecting holes 65*h*, a single hole 65*h* connecting with inlet port 65*c* could be used; three equally-spaced, interconnecting arc-shaped openings 63*b* then being required in housing 63, similar in principle to the inlet arrangement of motor 10.

Device 80 shows a variation of motor 60 in which arc-shaped opening 63*b* is replaced by a linear slot which includes a sliding bar, or guillotine. This guillotine can vary the degree of rotation during which inlet gases may enter the motor. Shaft housing 83 includes inlet 83*a*, opening 83*b*, guillotine 84 with adjusting screw 84*a*, spring 85 and adjusting nut 86. Changing the position of guillotine 84 can provide continuously variable expansion ratios of from about 3:1 to 9:1. Although means are not shown in FIG. 8 for installing guillotine 84, this may be readily accomplished by making removeable the portion of housing 83 adjacent nut 86. Obviously, as in the aforementioned variation to motor 60, three interconnected guillotine 84 could be used, only one inlet hole then being required in the disk.

Figure 9:
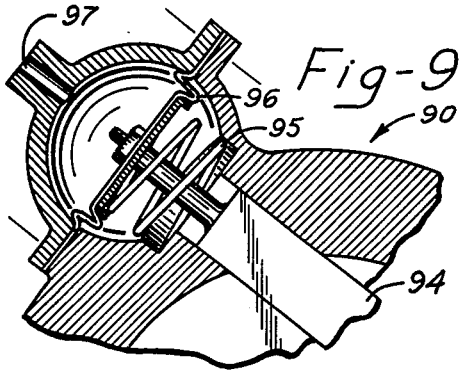
FIG. 9 is a cross sectional view of a portion of the shaft housing of a rotary gas expansion motor similar to that of FIG. 8, in which fluid acting on a diaphragm may be used to automatically change the gas expansion ratio.
Figure 8:
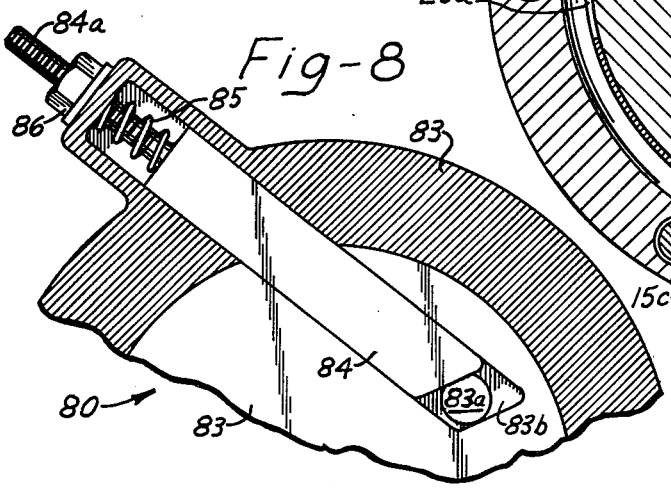
FIG. 8 is a cross sectional view of a portion of the shaft housing of a rotary gas expansion motor similar to that of FIG. 7, in which a manually adjustable guillotine is used to provide a variable gas expansion ratio.

In FIG. 9 there can be seen a diaphragm arrangement 90 for automatically changing the position of guillotine 94, the remainder of the motor being similar to that of FIGS. 6–7 as modified by FIG. 8. In FIG. 9, spring 95 tends to move guillotine 94 and diaphragm 96 radially outwards, thus decreasing the expansion ratio. If pressurized fluid is admitted to the outer side of diaphragm 96 through hole 97, guillotine 94 will be caused to move radially inwards, thus increasing the expansion ratio. This provides a means of regulating the angular velocity and torque of the motor. One useful application of diaphragm arrangement 90 would be to provide uniform angular velocity of the shaft of a gas operated motor with varying torque loads or varying inlet pressures, such as might be experienced if solar heated gases are used to operate the motor.

I claim

1. A rotary gas expansion motor comprising:

a generally triangular chamber, an elongate rotor, said rotor being rotatable end over end inside said chamber and serving to divide same into two compartments, a shaft with crank, said crank extending into a slot in said rotor and serving to divide said slot into two cells, a disk, said disk being coaxially affixed to said shaft adjacent said chamber and said rotor, said disk including an inlet port and an outlet port, said inlet port being shaped and positioned to begin communication with each said chamber compartment and each said slot cell when they begin to increase in size and to continue said communication for less than a full movement of said rotor in said chamber and said crank in said slot, so as to provide early cut off in inlet gas and thus require trapped gases to expand therein prior to departing said motor, said outlet port being shaped and positioned to communicate with each said chamber compartment and each said slot cell at all times they are decreasing in size.

2. The rotary gas expansion motor as claimed in claim 1 in which means are included for early cut off of inlet gas flow to said inlet port, so as to require additional expansion of said trapped gases.

3. The rotary gas expansion motor as claimed in claim 2 in which said cut off means comprises a stationary, slotted ring peripherally surrounding said disk.

4. The rotary gas expansion motor as claimed in claim 2 in which said cut off means comprises at least one slot in the housing axially adjacent said disk.

5. The rotary gas expansion motor as claimed in claim 4 in which a guillotine slides in said slot, to vary the length of said slot.

6. The rotary gas expansion motor as claimed in claim 5 in which a diaphragm is attached to said guillotine, so that fluid pressure acting on said diaphragm will vary the length of said slot.

* * * * *